US009455496B2

(12) United States Patent
Hsu

(10) Patent No.: US 9,455,496 B2
(45) Date of Patent: Sep. 27, 2016

(54) ANTENNA ASSEMBLY AND WIRELESS COMMUNICATION DEVICE USING SAME

(71) Applicant: Chi Mei Communication Systems, Inc., New Taipei (TW)

(72) Inventor: Cho-Kang Hsu, New Taipei (TW)

(73) Assignee: Chi Mei Communication Systems, Inc., New Taipei (TW)

( * ) Notice: Subject to any disclaimer, the term of this patent is extended or adjusted under 35 U.S.C. 154(b) by 328 days.

(21) Appl. No.: 13/947,660

(22) Filed: Jul. 22, 2013

(65) Prior Publication Data

US 2014/0097998 A1 Apr. 10, 2014

(30) Foreign Application Priority Data

Oct. 8, 2012 (TW) ..... 101137089 A

(51) Int. Cl.

| | |
|---|---|
| ***H01Q 1/50*** | (2006.01) |
| ***H01Q 5/00*** | (2015.01) |
| ***H01Q 5/50*** | (2015.01) |
| *H01Q 1/24* | (2006.01) |
| *H01Q 5/371* | (2015.01) |

(52) U.S. Cl.

CPC ..... *H01Q 5/0093* (2013.01); *H01Q 5/50* (2015.01); *H01Q 1/243* (2013.01); *H01Q 5/371* (2015.01)

(58) Field of Classification Search

CPC ..... H01Q 5/0093; H01Q 1/50; H01Q 1/243; H01Q 1/38; H01Q 9/42; H03H 7/38

USPC ..... 343/860, 700 MS, 795, 850, 866

See application file for complete search history.

(56) References Cited

U.S. PATENT DOCUMENTS

| | | | | |
|---|---|---|---|---|
| 8,754,826 | B2 * | 6/2014 | Ozone | H01Q 1/521 343/861 |
| 2008/0055173 | A1 * | 3/2008 | Chominski | H01Q 7/00 343/741 |
| 2011/0053636 | A1 * | 3/2011 | Park | 455/550.1 |
| 2011/0065429 | A1 * | 3/2011 | Kim et al. | 455/418 |
| 2012/0119959 | A1 * | 5/2012 | Mashima et al. | 343/702 |
| 2012/0218165 | A1 * | 8/2012 | Kato et al. | 343/852 |
| 2013/0088405 | A1 * | 4/2013 | Lee et al. | 343/861 |
| 2014/0049440 | A1 * | 2/2014 | Ueki | H01Q 1/36 343/852 |
| 2015/0045089 | A1 * | 2/2015 | He | 455/552.1 |
| 2015/0048992 | A1 * | 2/2015 | Martiskainen | H03H 7/38 343/852 |

* cited by examiner

*Primary Examiner* — Huedung Mancuso

(74) *Attorney, Agent, or Firm* — Zhigang Ma

(57) ABSTRACT

An antenna assembly includes an antenna, a radio frequency (RF) unit, and a matching unit. The antenna includes a first radiator and a second radiator. The matching unit is electronically connected between the antenna and the RF unit, and includes a first matching circuit and a second matching circuit. The first matching circuit matches impedance of the first radiator, and the second matching circuit matches impedance of the second radiator.

14 Claims, 3 Drawing Sheets

ANTENNA ASSEMBLY AND WIRELESS COMMUNICATION DEVICE USING SAME

BACKGROUND

1. Technical Field

The present disclosure relates to an antenna assembly for a wireless communication device.

2. Description of Related Art

Antennas are found in many wireless communication devices such as mobile phones for example. A wireless communication device may receive/transmit wireless signals having different frequencies, requiring the presence of a multiband antenna. However, many multiband antennas have complicated structures and are large in size, making it difficult to miniaturize wireless electronic devices.

Therefore, there is room for improvement within the art.

BRIEF DESCRIPTION OF THE DRAWINGS

Many aspects of the disclosure can be better understood with reference to the drawings. The components in the drawings are not necessarily drawn to scale, the emphasis instead being placed upon clearly illustrating the principles of the disclosure. Moreover, in the drawings, like reference numerals designate corresponding parts throughout the views.

DETAILED DESCRIPTION

Figure 1:
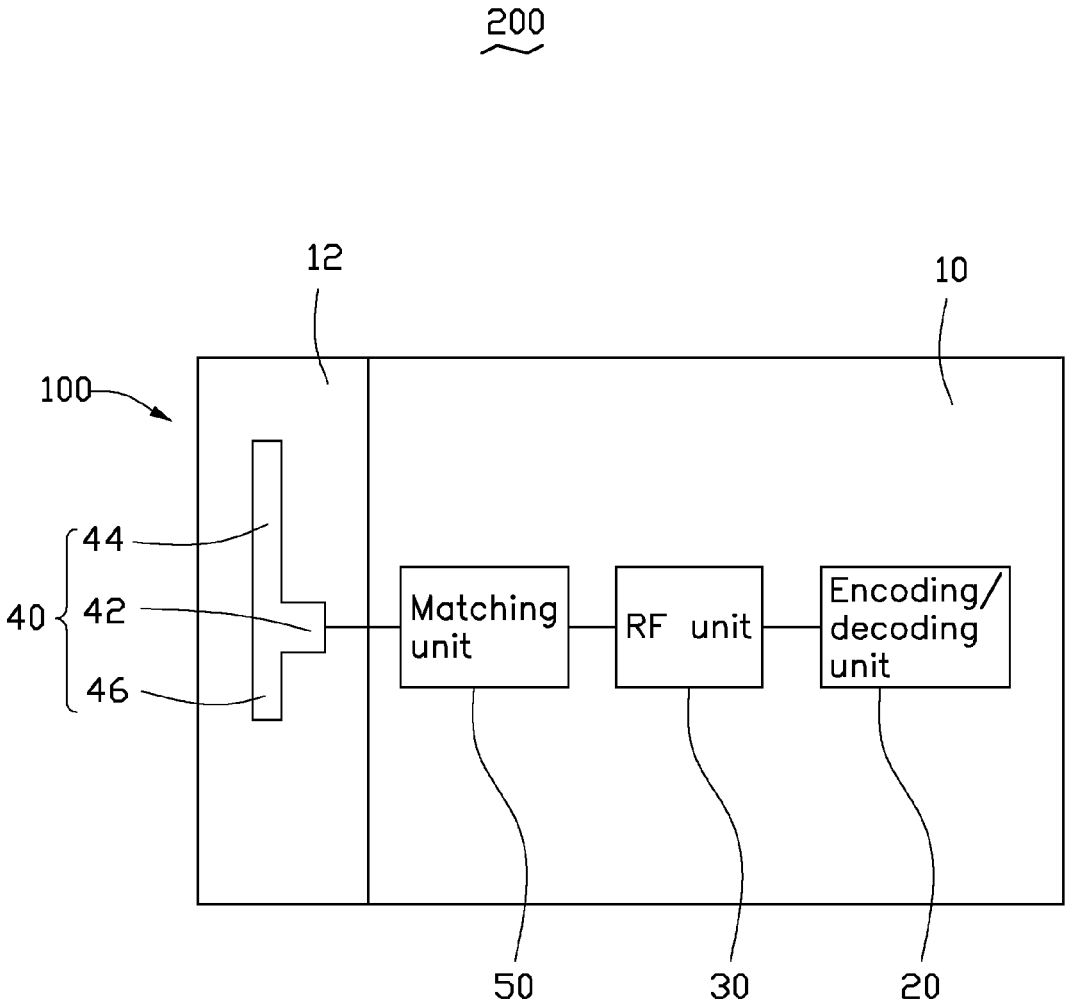
FIG. 1 is a block diagram of an antenna assembly, according to an exemplary embodiment.

FIG. 1 shows an antenna assembly 100 according to an exemplary embodiment. The antenna assembly 100 is employed in a wireless communication device 200. The wireless communication device 200 may be a mobile phone or a personal digital assistant, for example.

The antenna assembly 100 includes a base board 10, an encoding/decoding unit 20, a radio frequency (RF) unit 30, an antenna 40, and a matching unit 50.

In the exemplary embodiment, the base board 10 is a printed circuit board (PCB) of the wireless communication device 200, and is made of composite materials. The base board 10 is a substantially rectangular board having a keep-out-zone 12. The purpose of keep-out-zone 12 is to not permit other elements (such as a camera, a vibrator, a speaker, etc.) on the base board 10 to be placed in a predetermined area where it may interfere with the antenna 40. In the exemplary embodiment, the keep-out-zone 12 is located at an end of the base board 10.

The encoding/decoding unit 20 and the RF unit 30 are interconnected, and both are positioned on the base board 10. The RF unit 30 is configured to modulate baseband signals or demodulate RF signals. The encoding/decoding unit 20 is configured to decode audio signals from the RF signals, and encode audio signals into the baseband signals.

The antenna 40 can be a metal sheet, a flexible printed circuit (FPC), or other conductors processed by laser direct structuring (LDS). The antenna 40 is positioned in the keep-out-zone 12. In the exemplary embodiment, the antenna 40 is substantially T-shaped, and includes a feed portion 42, a first radiator 44, and a second radiator 46. The feed portion 42 is electronically connected to the base board 10 via elastic sheets, coplanar waveguide (CPW) lines, strip lines, micro-strip lines, or coaxial cables, to receive current. The first radiator 44 and the second radiator 46 are connected to two opposite ends of the feed portion 42, and then form a first current path and a second current path, respectively. Thus, the antenna 40 can be a dual-band antenna. In the exemplary embodiment, a length of the first radiator 44 is greater than a length of the second radiator 46.

Figure 2:
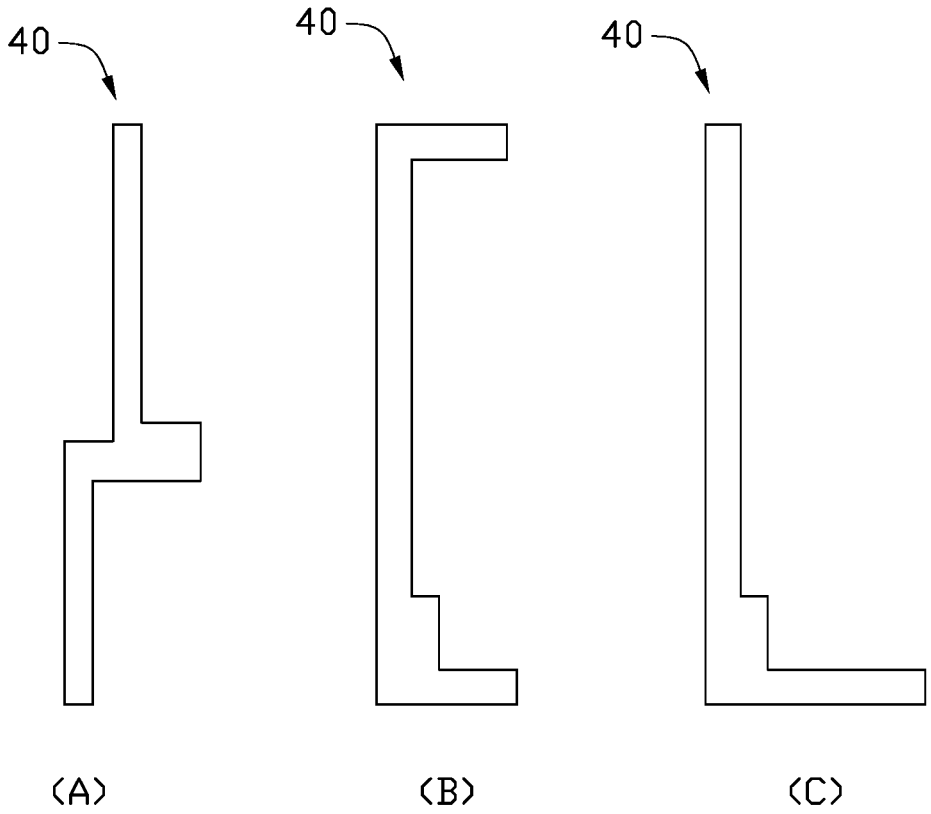
FIG. 2 is a schematic view of an antenna of the antenna assembly in FIG. 1.

In other exemplary embodiments, the antenna 40 can be other structures. For example, referring to FIG. 2, the antenna 40 can be irregular T-shaped, U-shaped, or L-shaped.

Figure 3:
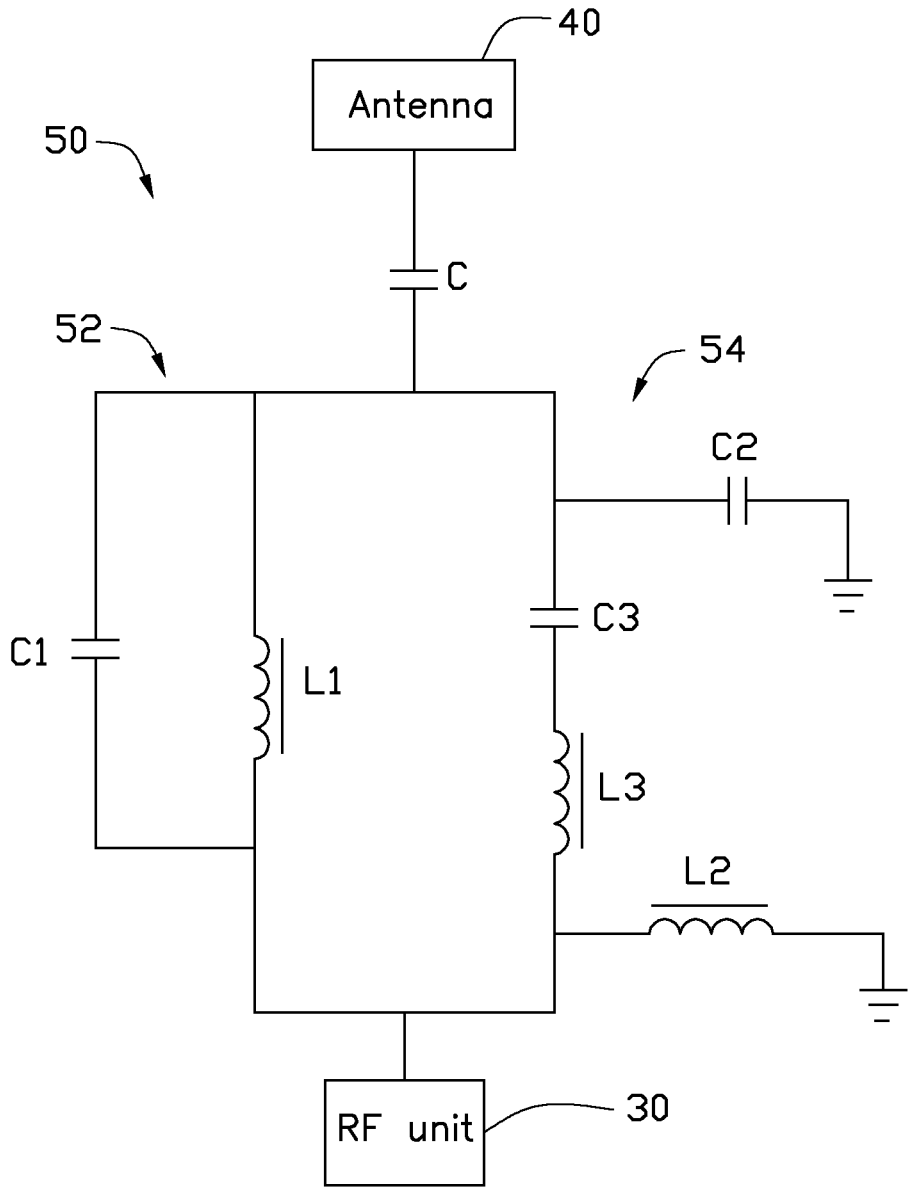
FIG. 3 is a circuit view of a matching unit of the antenna assembly shown in FIG. 1.

Referring to FIG. 3, the matching unit 50 is electronically connected between the RF unit 30 and the antenna 40, to match impedance of the antenna 40. In the exemplary embodiment, the matching unit 50 includes a common capacitor C, a first matching circuit 52 and a second matching circuit 54. The first matching circuit 52 and the second matching circuit 54 are electronically connected in parallel. The first matching circuit 52 and the second matching circuit 54 are electronically connected between the feed portion 42 of the antenna 40 and the RF unit 30. The first matching circuit 52 matches impedance of the first radiator 44, and the second matching circuit 54 matches impedance of the second radiator 46.

The common capacitor C is electronically connected to the antenna 40. The first matching circuit 52 includes a first capacitor C1 and a first inductor L1. The first capacitor C1 and the first inductor L1 are electronically connected between the RF unit 30 and the common capacitor C in parallel. By adjusting a capacitance of the common capacitor C and the first capacitor C1, and an inductance of the first inductor L1, the antenna 40 can be used to receive and transmit wireless signals having a first central frequency, such as LTE 700, GSM 850/900, for example.

The second matching circuit 54 includes a second inductor L2, a third inductor L3, a second capacitor C2, and a third capacitor C3. The third inductor L3 and the third capacitor C3 are electronically connected between the RF unit 30 and the common capacitor C in series. A first end of the second inductor L2 is electronically connected between the RF unit 30 and the third inductor L3, and a second end of the second inductor L2 is grounded. A first end of the second capacitor C2 is electronically connected between the common capacitor C and the third capacitor C3, and a second end of the second capacitor C2 is grounded. By adjusting a capacitance of the common capacitor C, the second capacitor C2 and the third capacitor C3, and an inductance of the second inductor L2 and the third inductor L3, the antenna 40 can be used to receive and transmit wireless signals having a second central frequency, such as DCS/PCS/UMTS2100, for example.

When current is input to the antenna 40 from the base board 10, the antenna 40 is activated for receiving and transmitting wireless signals having the first central frequency and the second central frequency. Additionally, the matching unit 50 provides impedance matching for the antenna 40 to improve radiating performance of the antenna 40, and thus, the antenna 40 does not need complicated structures. Therefore, the antenna assembly 100 is small in size and has good communication quality at a plurality of frequency bands used in wireless communications, which allows further size reductions of the wireless communication device 200 employing the antenna assembly 100.

It is to be understood, however, that even through numerous characteristics and advantages of the present disclosure have been set forth in the foregoing description, together with details of assembly and function, the disclosure is illustrative only, and changes may be made in detail, especially in the matters of shape, size, and arrangement of parts within the principles of the disclosure to the full extent indicated by the broad general meaning of the terms in which the appended claims are expressed.

What is claimed is:

1. An antenna assembly, comprising:

an antenna having a first radiator and a second radiator;

a radio frequency (RF) unit; and a matching unit electronically connected between the antenna and the RF unit;

wherein the matching unit comprises a first matching circuit and a second matching circuit electronically connected in parallel, the first matching circuit and the second matching circuit are electronically connected between a feed portion of the antenna and the RF unit, the first matching circuit matches impedance of the first radiator to allow the antenna to receive and transmit wireless signals having a first central frequency, and the second matching circuit matches impedance of the second radiator to allow the antenna to receive and transmit wireless signals having a second central frequency.

2. The antenna assembly as claimed in claim 1, wherein the matching unit further comprises a common capacitor electronically connected to antenna.

3. The antenna assembly as claimed in claim 2, wherein the first matching circuit comprises a first capacitor and a first inductor, the first capacitor and the first inductor are electronically connected in parallel, the first capacitor and the first inductor are electronically connected between the RF unit and the common capacitor.

4. The antenna assembly as claimed in claim 2, wherein the second matching circuit comprises a second inductor, a third inductor, a second capacitor, and a third capacitor, the third inductor and the third capacitor are electronically connected between the RF unit and the common capacitor in series, a first end of the second inductor is electronically connected between the RF unit and the third inductor, and a second end of the second inductor is directly grounded, a first end of the second capacitor is electronically connected between the common capacitor and the third capacitor, and a second end of the second capacitor is directly grounded.

5. The antenna assembly as claimed in claim 1, further comprising a base board, wherein the base board comprises a keep-out-zone, and the antenna is positioned in the keep-out-zone.

6. The antenna assembly as claimed in claim 5, wherein the feed portion is electronically connected to the base board to receive current.

7. The antenna assembly as claimed in claim 6, wherein the first radiator and the second radiator are connected to two opposite ends of the feed portion.

8. A wireless communication device, comprising:

a base board;

an antenna positioned on the base board, the antenna comprising a first radiator and a second radiator;

a radio frequency (RF) unit; and a matching unit electronically connected between the antenna and the RF unit;

wherein the matching unit comprises a first matching circuit and a second matching circuit electronically connected in parallel, the first matching circuit and the second matching circuit are electronically connected between a feed portion of the antenna and the RF unit, the first matching circuit matches impedance of the first radiator of the antenna to allow the antenna to receive and transmit wireless signals having a first central frequency, and the second matching circuit matches impedance of the first radiator of the antenna to allow the antenna to receive and transmit wireless signals having a second central frequency.

9. The wireless communication device as claimed in claim 8, wherein the matching unit further comprises a common capacitor electronically connected to antenna.

10. The wireless communication device as claimed in claim 9, wherein the first matching circuit comprises a first capacitor and a first inductor, the first capacitor and the first inductor are electronically connected in parallel, the first capacitor and the first inductor are electronically connected between the RF unit and the common capacitor.

11. The wireless communication device as claimed in claim 9, wherein the second matching circuit comprises a second inductor, a third inductor, a second capacitor, and a third capacitor, the third inductor and the third capacitor are electronically connected between the RF unit and the common capacitor in series, a first end of the second inductor is electronically connected between the RF unit and the third inductor, and a second end of the second inductor is directly grounded, a first end of the second capacitor is electronically connected between the common capacitor and the third capacitor, and a second end of the second capacitor is directly grounded.

12. An antenna assembly, comprising:

an antenna having a first radiator and a second radiator;

a radio frequency (RF) unit; and a matching unit electronically connected between the antenna and the RF unit;

wherein the matching unit comprises a first matching circuit and a second matching circuit electronically connected in parallel, the first matching circuit and the second matching circuit are electronically connected between a feed portion of the antenna and the RF unit, the first matching circuit matches impedance of the first radiator, and the second matching circuit matches impedance of the second radiator;

wherein the second matching circuit comprises a second inductor, a third inductor, a second capacitor, and a third capacitor, the third inductor and the third capacitor are electronically connected between the RF unit and the feed portion in series, a first end of the second inductor is electronically connected between the RF unit and the third inductor, and a second end of the second inductor is directly grounded, a first end of the second capacitor is electronically connected between the feed portion and the third capacitor, and a second end of the second capacitor is directly grounded.

13. The antenna assembly as claimed in claim 12, wherein the matching unit further comprises a common capacitor electronically connected to antenna.

14. The antenna assembly as claimed in claim 13, wherein the first matching circuit comprises a first capacitor and a first inductor, the first capacitor and the first inductor are electronically connected between the RF unit and the common capacitor in parallel.

* * * * *